United States Patent [19]

Colgate

[11] 3,973,628

[45] Aug. 10, 1976

[54] IN SITU SOLUTION MINING OF COAL

[75] Inventor: Stirling A. Colgate, Ward, Colo.

[73] Assignee: New Mexico Tech Research Foundation, Socorro, N. Mex.

[22] Filed: Apr. 30, 1975

[21] Appl. No.: 573,244

[52] U.S. Cl. ..... 166/283; 166/272; 166/303; 299/5

[51] Int. Cl.[2] ..... E21B 43/26; E21C 41/04

[58] Field of Search ..... 166/303, 272, 261, 260, 166/256, 259, 267, 283; 299/2–4, 5

[56] References Cited

UNITED STATES PATENTS

| | | | |
|---|---|---|---|
| 2,595,979 | 5/1952 | Pevere et al. | 166/303 |
| 3,007,520 | 11/1961 | Frey | 166/260 |
| 3,102,588 | 9/1963 | Fisher | 166/261 |
| 3,208,514 | 9/1965 | Dew et al. | 166/261 |
| 3,598,182 | 8/1971 | Justheim | 166/267 X |
| 3,616,855 | 11/1971 | Colgate | 166/308 X |

*Primary Examiner*—Stephen J. Novosad
*Attorney, Agent, or Firm*—Brumbaugh, Graves, Donohue & Raymond

[57] ABSTRACT

Underground strata surrounding a coal seam are prestressed by repeated fracturing with a settable material to strengthen and seal the strata to contain a hydrostatic pressure in the coal seam of about 100 to about 500 atmospheres, thereby providing a gas and liquid-tight seal surrounding and within the coal seam. After the strata surrounding the coal seam and the coal seam itself are sealed, an hydrogenating agent is supplied to the coal seam and is maintained at a temperature of approximately 300 to 500 degrees centigrade and a pressure of from about 100 to about 500 atmospheres to liquefy and hydrogenate the coal in situ. When a region of coal is liquefied out to the boundary of the prestressing, the liquefied coal is pumped out for use.

15 Claims, 1 Drawing Figure

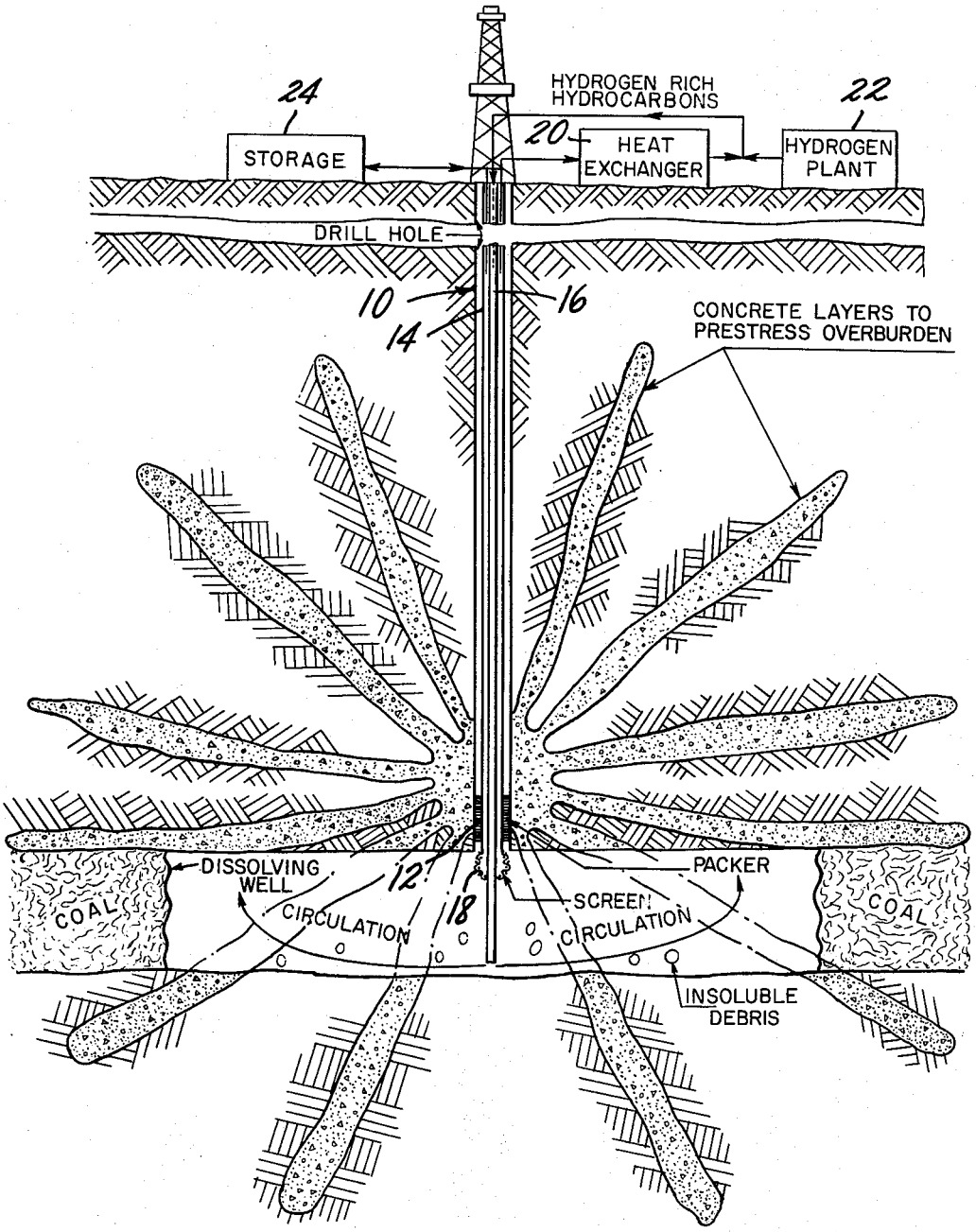
24
STORAGE
HYDROGEN RICH
HYDROCARBONS
20
HEAT
EXCHANGER
22
HYDROGEN
PLANT
DRILL HOLE
10
14
16
CONCRETE LAYERS TO
PRESTRESS OVERBURDEN
DISSOLVING
WELL
12
18
PACKER
SCREEN
CIRCULATION
CIRCULATION
COAL
COAL
INSOLUBLE
DEBRIS

IN SITU SOLUTION MINING OF COAL

BACKGROUND OF THE INVENTION

The present invention relates to in situ liquefaction and hydrogenation of coal and, more particularly, to a method of solution mining an underground coal seam involving the heating, pressurizing and chemical processing of the coal so that it may be extracted from underground as a liquid.

Geological exploration has demonstrated the existence of countless relatively thick coal seams at depths of on the order of 500 meters. Heretofore, the depth of burial has hindered recovery of the coal because of the high cost of strip mining or conventional mining at such depth. Furthermore, the recovery of the coal in many such seams has been further complicated because the coal is interspersed with layers of shale which make the coal uneconomical to mine with continuous mining equipment, principally because of rapid wear caused by the shale. However, because of the present uncertainty about the availability of known liquid petroleum resources, current and predicted prices of crude oil, and rapid depletion of the world's oil, the successful, efficient extraction of deep deposits of coal is of significant potential commercial importance.

Coal, in general, is a solidified hydrocarbon. Although anthracite coal is close enough to pure carbon to be considered insoluble, the more abundant bituminous coals, which have a molecular hydrogen to carbon ratio of approximately 0.8 hydrogen to one carbon and a chemical structure bound to a significant extent by oxygen bonds between multiple benzene ring-type hydrocarbons, may be dissolved in other benzene ring compounds at high temperature because of the large hydrogen content.

Since bituminous coal is soluble in appropriate solvents, above-ground hydrogenation processes heretofore proposed and utilized for producing petroleum from coal depend upon the initial solubility of coal at high temperature and high pressure in an appropriate solvent. In those hydrogenation processes, the coal is hydrogenated by donor hydrogen from the solvent which is then reconstituted or hydrogenated in either a separate or the same process so that the solvent is sequentially used as a donor and then recipient of hydrogen. The hydrogenated coal becomes a liquid composed of hydrogen-poor solvents. However, the above-ground hydrogenation of coal requires the mining of the coal, processing of the coal and expensive reactor or pressure vessel for providing the high temperature and high pressure required to induce the hydrogen exchange between the solvent and the coal.

Inasmuch as the reactions involved in the hydrogenation of coal also proceed quite rapidly for underground processing, provided the hydrogen or hydrogen donor and the requisite temperature and pressure are available, it has been suggested that underground coal may be removed through a drill pipe by a process similar to the Frasch process which is used for extracting sulphur from deep deposits. The Frasch process utilizes hot water which is pumped down a pipe in a well bore to melt the sulphur; the liquefied sulphur is forced up to the surface through another pipe.

Although there are a few high boiling, aromatic solvents, e.g., phenanthrene and carbozole, having a relatively high molecular weight and a capability of dissolving coal at atmospheric pressure when heated to an appropriate solubility temperature, the fraction of those solvents in the coal tars is too small for commercial utilization in cyclic extraction processes. Accordingly, low boiling, benzene ring compounds having a comparatively low molecular weight should be used. Since these low boiling, aromatic compounds have higher vapor pressures at the temperatures required for solubility, their employment in the liquefaction and extraction of coal, on a commercial scale, requires high pressure as well as high temperature. In addition, hydrogen gas should be added to the solvent, requiring a high pressure for a finite solubility.

Since the liquefied coal being extracted can be used to transfer its heat to the down-flowing stream of hydrogenated solvent, the underground heat required to liquefy the coal is dependent upon the amount of heat diffused into the rocks surrounding the coal seam. Calculations indicate that the diffusion of heat into the surrounding rock media approximately doubles the heat required for hydrogenation. Moreover, the diffusion of the solvent is increased by the relatively high pressures utilized in the hydrogenation process which cause the solvent to leak into the strata above and below the coal seam. Thus, although the possibility of in situ hydrogenation of coal has been long recognized, a commercially feasible method for hydrogenating coal in situ has heretofore been impossible because of inadequate strength in the strata above and below the coal seam to permit sufficient pressure to be developed in the coal seam for effective hydrogenation of the coal.

SUMMARY OF THE INVENTION

There is provided, in accordance with the present invention, a method of liquefying coal in situ in an underground coal seam that significantly enhances the commercial feasibility of such an operation by permitting the coal to be subjected to high temperatures and high pressures without excessive heat and solvent loss. More particularly, the method involves selectively stressing the underground formations above and below the coal seam to seal the boundary of the coal seam to contain a hydrostatic pressure of from about 100 to about 500 atmospheres and thereby provide a gas and fluid-tight, zone containing in the coal seam. The stressing of the strata is carried out by a procedure of sequential fracturing with a settable material similar to that described in U.S. Pat. No. 3,616,855, issued Nov. 2, 1971. That patent describes a sequential fracturing technique for prestressing the ground above a selected strata for preparing that strata for bulking. Unlike the conventional hydraulic fracturing operations utilized in the oil industry which produces a crack that is permeable to allow fluid to flow readily through the fracture. The sequential fracturing technique described in that patent involves filling the crack with a settable material to maintain a positive, sealed displacement after the crack has been made. When used for mining purposes, the sequential fracturing technique creates arch stresses, in the form of adjacent overstressed regions ("over-stressed" in the sense of being greater than the natural stress due to over-burden) which support or bridge the ground above the strata during the removal of the rock from the strata.

In the sequential fracturing operation used in the present invention, a zone of a drill hole immediately above a coal seam is isolated by packers, and a settable fluid, e.g., concrete, is pumped down a high pressure tubing string to fracture the underground formation.

The first fracture jacks apart the rock formation by a small but significant amount over an area determined by the initial volume of the settable fluid pumped down the drill hole and the rheological properties of the then unset material, such properties being controlled by compounding; for example, gels can be used in the settable material to control the distance the material flows into the strata from the well bore. After the settable material has set, or otherwise stabilized, in the fracture, the fracturing process is repeated, and the rock formation is jacked apart by an additional increment. By repeatedly fracturing with the settable material, additional fractures are created, the fractures propagating in various directions and each fracture increasing the stress in the fractured zone and "tightening" the zone. By repeated fracturing then, the strata surrounding the underground coal seam can be overstressed to many times the overburden stress to seal the boundary of the coal seam so that it can hold pressures greater than the overburden pressure.

After the boundaries of the coal seam have been sealed, an hydrogenating agent is circulated to and from the coal seam to dissolve the coal. The hydrogenating agent is maintained in the coal seam at a pressure of from about 100 to about 500 atmospheres and a temperature of approximately 300 to 500 degrees centigrade so that the coal in the coal seam may be liquefied and hydrogenated underground. The hydrogenating agent may be hydrogen or any hydrogen-containing compound that is a solvent for the coal (i.e., that dissolve the coal) under the temperature and pressure conditions maintained. Numerous hydrogenating agents for coal and the conditions for their use are known per se, examples being various aramatic compounds, hydrogen-rich hydrocarbons, methane and pure hydrogen.

The reactions involved in the underground hydrogenation of coal proceed quite rapidly without a catalyst as long as the requisite amount of hydrogen or hydrogen donor is supplied under appropriate temperature and pressure conditions. However, in some situations, a catalyst, e.g., iron oxide, may be used to speed up the reaction and offer economic advantages.

BRIEF DESCRIPTION OF THE DRAWING

For a better understanding of the invention, reference may be made to the following description of an exemplary embodiment, taken in conjunction with the single FIGURE of the accompanying drawing which illustrates diagrammatically a mode of carrying out the invention.

EXAMPLE OF STRESSING STRATA

A cased drill hole is made in the earth down to the zone to be stressed around an underground coal seam. The drill hole is either initially terminated or is packed off by a bridge plug a few yards above the coal seam. A packer is set several yards above the bottom of the drill hole or above the bridge plug at the end of a high pressure tubing string. The rock strata is then fractured down the tubing string with a low quality cement, e.g., 8:1 silted sand to cement ratio, of a sufficient quantity to drive a fracture over an area determined by the initial volume of cement pumped and the rheology of the cement. The lateral extent of the fracture may be traced with geophones. After termination of the cement fracturing, the cement is cleaned from the tubing string and the first several yards of the fracture by a mud and water flush circulated down the tubing and up the annulus between the tubing and the casing or vice versa. Since a low quality, high aggregate ratio cement is utilized, it results in non-setting mud after dilution by the mud and water flush. After the flushing operation is completed, the fracture pressure is held static until the cement has set for several hours. The strength of the cement does not have to be great, but may advantageously be sufficient to support the fracture without any "shut-in" pressure. Additional fractures are then made, with the pressure required to fracture the rock strata incrementally increasing each time the fracturing operation is repeated.

A sequence of such incremental fractures provides displacements of the strata which cause an increase in the stress normal to the plane of fracture. This stress may be built up to an arbitrarily high value, i.e., to an arbitrary multiple of the overburden pressure, except that other fracture planes open whenever the stress is built up to a value such that the subsequent fracture finds it easier to propagate in a new direction. In the sequential fracturing process, fractures propagate in all directions forming a substantially spherical region of overstress composed of zones in the strata above and below the coal seam itself. The stress in this region can be larger than the overburden stress by a factor which is roughly the square of the burial depth measured in units of the diameter of the overstressed region. When the fracture pressure after a series of repeated fractures reaches a value indicative of desired overstress, say on the order of 10,000 psi, this means that an overstressed region encompassing the coal seam has been formed. The string and packer are pulled, and the drill hole is opened by drilling to the bottom of the coal seam or removing the bridge plug. The drill hole is then cased to the top of the coal seam.

EXEMPLARY EMBODIMENT OF IN SITU SOLUTION MINING OF COAL

Referring now to the drawing, after the overstressed region has been formed, a doublet tubing string 10 is run in the cased hole, and a high temperature, high pressure packer 12 at the end of the string is set several yards above the coal seam, approximately at the center of the overstressed region. The doublet string 10 comprises an inner supply pipe 14 and a concentric outer return pipe 16, the supply pipe 14 having a smaller diameter than the return pipe 16. The supply pipe 14 is preferably designed for the same working pressure as that used in the fracturing operation, about 10,000 psi. The supply pipe 14 and return pipe 16 should be manufactured from a metal capable of resisting hydrogen embrittlement. The return pipe 16 should have a diameter such that a cross-sectional area of the annulus between it and the supply pipe is approximately twice that of the supply pipe 14 to accommodate the cooler and possibly more viscous liquefied coal. The pipe sizes are chosen so that at a circulatory pressure drop of 1,000 psi the entire volume of the liquefied coal can be circulated several times per year.

After the doublet pipe is extended to the bottom of the coal seam, screens 18 are set at the end to prevent plugging. The return pipe 16, which is concentric with the casing, should be thermally insulated with a lightweight, aggregate-like perlite or expanded mica.

Before beginning the hydrogenation operation, it is desirable to heat up the system, such as by circulating lightweight oil, e.g., diesel oil, heated in a heat exchanger 20 for several days through the supply and return pipes 14 and 16, respectively, until the temperature of the pipes and the initial cavity created by the liquefication of the coal seam is high enough so that a subsequent charge of a heavier solvent will not solidify if a pump or heater break-down occurs. Circulation of the hydrogenating agent is then begun.

Many different hydrogenating agents may be employed in the hydrogenation and liquefaction process. For example, the hydrogenating agent may be an aromatic solvent having a vapor pressure at 350 to 400° centigrade sufficiently low to dissolve the coal at about 100 atmospheres pressure. An hydrogen-rich hydrocarbon having a vapor pressure at 400 to 500° centigrade sufficiently low to dissolve the coal at about 300 atmospheres pressure may also be used. When the aromatic solvent or the hydrogen-rich hydrocarbon is employed, the hydrogenating agent is hydrogenated by hydrogen gas added to it by a hydrogen forming plant 22.

At higher pressures, about 300 to about 500 atmospheres, methane or pure hydrogen may be used as the hydrogenating agent, the methane or pure hydrogen being supplied directly to the coal seam at a temperature sufficient to hydrogenate, as well as liquefy, the coal in situ. Since the heated methane or pure hydrogen will hydrogenate and liquefy the coal in the coal seam, the necessity of providing the hydrogen forming plant 22 to hydrogenate the hydrogenating agent may be eliminated.

The hydrogenation of coal is exothermic by approximately 50 K cal/mole of hydrogen added, therefore, after a while more heat will be added by the hydrogenation reaction than is lost by conduction. When the heat added by the hydrogenation reaction exceeds the heat lost by conduction, the heat exchanger 20 becomes a cooler, whereby the heat given off by the hydrogenation process may be used for other purposes. If desired, a catalyst, e.g., iron oxide, may be added to the hydrogenating agent to speed up the hydrogenation reaction.

The liquefied coal is circulated between the coal seam and the surface until a predetermined amount of the coal is dissolved. The hydrogenating agent is, of course, replenished or enriched by hydrogen as required by additions to the circulating liquefied coal, and the liquefied coal is extracted and stored to the extent required by addition of solvent as the hydrogenation proceeds. For example, as shown in the drawing, hydrogen may be added to the circulating liquefied coal. Initially, the thermal losses will be relatively large, and the hydrogenating agent returning to the surface will have to be passed through the heat exchanger 20 for reheating before the hydrogen is depleted. With the continuing dissolution of the coal seam, the thermal losses decrease and the retention time of the hydrogenating agent underground can be adjusted to allow for depletion of the excess hydrogen. As the coal seam is dissolved, the shale and a very much smaller fraction of cement from prestressing interspersed therethrough falls to the bottom of the cavity as insoluble debris without participating in the hydrogenation reaction.

When the cavity created by the liquefaction of the coal in the coal seam reaches a radius such that the total force upwards, i.e., pressure times area, is greater than the force exerted downward by the combined overburden pressure and over-stressed region above, the high pressure required can no longer be maintained, and the liquefied coal may start to leak out of the cavity. Therefore, the solution mining operation should be terminated at a cavity radius which creates an upward force which is greater than the downward forces exerted by the overburden pressure and over-stressed region.

After the coal seam has been sufficiently dissolved, the liquefied coal may be extracted by a pump (not shown). If the coal is sufficiently hydrogenated underground (about 40% mole fraction of hydrogen added), the liquefied coal will remain a liquid after extraction and can be stored in a storage device 26 for eventual use and transport as petroleum. On the other hand, if the liquefied coal returning to the surface is less hydrogenated (about 20% mole fraction), the dissolved coal is precipitated from the hydrogenating agent and the hydrogenating agent recycled.

The exemplary embodiment shown in the drawing describes a single-well system. In operation of the single-well system, a hot hydrogenating agent is pumped down a well bore to dissolve the coal, the hydrogenating agent and liquefied coal being forced back to the surface through a separate pipe in the same well bore. Alternatively, a two-well system or other multiple-well system may be employed. In operation of the two-well or multiple-well system, the hot hydrogenating agent is pumped down to the coal seam through one or more wells, and the hydrogenating agent then flows horizontally through macro-fractures in the coal bed to another well or wells through which the hydrogenating agent and the liquefied coal are pumped to the surface.

Liquefied coal itself may be used as a settable material for stressing the zone in and around the coal seam being produced, provided it is not hydrogenated far enough to remain a liquid at the temperature of the strata surrounding the coal seam. In one form of a process of stressing the zone using liquefied coal, liquefaction is started under high temperatures at a pressure below overburden pressure and carried on until the coal is hydrogenated to a point that it is a liquid at high temperature but solidifies in the strata, say about 20% mole fraction of hydrogen added. The down-hole pressure is then increased to above overburden to produce fractures by the still liquid coal. Upon cooling the coal in the fractures solidifies and sets like cement or any other settable material in sustaining the overstress. In situ hydrogenation then proceeds in the usual manner.

In another form of fracturing with hydrogenated, settable coal, the fracturing with the coal is carried out after a period of production in a cement-stressed zone to extend the zone for additional production or to tighten a formation that has started to leak.

The above-described embodiments of the invention are intended to be merely exemplary, and numerous variations and modifications of them will be apparent to those skilled in the art without departing from the spirit and scope of the invention. All such variations and modifications are intended to be included within the scope of the invention as defined in the appended claims.

I claim:

1. A method of liquefying coal by in situ hydrogenation in an underground coal seam located adjacent strata initially stressed naturally not greater than the natural overburden stress comprising the steps of selectively stressing the underground strata around and in the coal seam so that the strata is stressed substantially in excess of the natural overburden stress to seal the boundary of the coal seam to contain a hydrostatic pressure in the coal seam of from about 100 to about 500 atmospheres, supplying an hydrogenating solvent for the coal to the coal seam and maintaining the hydrogenating solvent in the coal seam at a temperature of from about 300 to about 500° centigrade and a pressure of from about 100 to about 500 atmospheres.

2. A method according to claim 1 wherein the hydrogenating solvent is an aromatic compound having a vapor pressure at from about 350 to about 400° centigrade sufficiently low to dissolve the coal in the coal seam.

3. A method according to claim 1 further comprising the step of adding a catalyst to the hydrogenating solvent for speeding up the hydrogenation of the coal.

4. A method according to claim 4 wherein the catalyst is iron oxide.

5. A method according to claim 1 wherein the strata is stressed by sequentially and repeatedly fracturing with a settable fluid to provide a gas and fluid-tight, overstressed cavity when the coal in the coal seam is liquefied.

6. A method according to claim 5 wherein the settable fluid is a cement.

7. A method according to claim 1 wherein the hydrogenating solvent is an hydrogen-rich hydrocarbon having a vapor pressure at 400 to 500° centigrade sufficiently low to dissolve the coal in the coal seam.

8. A method according to claim 1 further comprising the step of extracting the hydrogenating solvent and the liquefied coal from the underground coal seam.

9. A method according to claim 8 further comprising the steps of precipitating the coal from the extracted liquefied coal, and recycling the hydrogenating solvent remaining after the coal has been precipitated.

10. A method according to claim 8 wherein the coal is suffiently hydrogenated underground to remain a liquid after extraction, whereby the liquefied coal can be used and transported as petroleum.

11. A method according to claim 1 wherein the hydrogenating solvent is methane.

12. A method according to claim 1 wherein the hydrogenating solvent is pure hydrogen.

13. A method of liquefying coal is situ in an underground coal seam by hydrogenation thereof comprising the steps of sequentially and repeatedly fracturing the underground strata around and in the coal seam with hydrogenated coal that is a fluid at a temperature maintained in the coal seam and settable at a temperature in the strata around the coal seam to seal the boundary of the coal seam to contain a hydrostatic pressure in the coal seam of from about 100 to about 500 atmospheres and to provide a gas and fluid-tight, overstressed cavity when the coal in the coal seam is liquefied, supplying an hydrogenating solvent for the coal to the coal seam and maintaining the hydrogenating solvent in the coal seam at a temperature of from about 300 to about 500° centigrade and a pressure of from about 100 to about 500 atmospheres.

14. A method of liquefying coal in situ in an underground coal seam by hydrogenation thereof comprising the steps of stressing the underground strata around and in the coal seam with a settable cement to seal the boundary of the coal seam to contain a hydrostatic pressure in the coal seam of from about 100 to about 500 atmospheres, supplying an hydrogenating solvent for the coal to the coal seam, maintaining the hydrogenating solvent in the coal seam at a temperature of from about 300 to about 500° centigrade and a pressure of from about 100 to about 500 atmospheres and fracturing further the underground strata around and in the coal seam with hydrogenated coal that is a fluid at a temperature maintained in the coal seam and is settable at a temperature in the strata around the coal seam to increase the stress of the underground strata.

15. A method of liquefying coal in situ in an underground coal seam by hydrogenation thereof comprising the steps of supplying an hydrogenating solvent for the coal to the coal seam, maintaining the hydrogenating solvent in the coal seam at a pressure below the overburden stress of the underground strata and a temperature sufficiently high and a time sufficiently long to hydrogenate a selected volume of the coal in the coal seam and fracturing the underground strata around and in the coal seam with said selected volume of hydrogenated coal, said hydrogenated coal being a fluid at a temperature maintained in the coal seam and settable at a temperature in the strata around the coal seam, thereby to seal the boundary of the coal seam to contain a hydrostatic pressure in the coal seam in excess of the overburden stress.

* * * * *

UNITED STATES PATENT OFFICE

CERTIFICATE OF CORRECTION

Patent No. 3,973,628 Dated August 10, 1976

Inventor(s) Stirling A. Colgate

It is certified that error appears in the above-identified patent and that said Letters Patent are hereby corrected as shown below:

Cover page, item [73], should read -- New Mexico Tech Research Foundation, a part interest --.

Signed and Sealed this Third Day of May 1977

[SEAL]

*Attest:*

RUTH C. MASON
*Attesting Officer*

C. MARSHALL DANN
*Commissioner of Patents and Trademarks*